US011230780B2

(12) United States Patent
Yamakawa et al.

(10) Patent No.: US 11,230,780 B2
(45) Date of Patent: Jan. 25, 2022

(54) COPPER OXIDE SOLID FOR USE IN PLATING OF A SUBSTRATE, METHOD OF PRODUCING THE COPPER OXIDE SOLID, AND APPARATUS FOR SUPPLYING A PLATING SOLUTION INTO A PLATING TANK

(71) Applicant: EBARA CORPORATION, Tokyo (JP)

(72) Inventors: Junitsu Yamakawa, Tokyo (JP); Chunhui Dou, Tokyo (JP); Risa Kimura, Tokyo (JP); Toshio Yokoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/268,036

(22) PCT Filed: Jul. 30, 2019

(86) PCT No.: PCT/JP2019/029751
§ 371 (c)(1),
(2) Date: Feb. 11, 2021

(87) PCT Pub. No.: WO2020/039856
PCT Pub. Date: Feb. 27, 2020

(65) Prior Publication Data

US 2021/0180202 A1 Jun. 17, 2021

(30) Foreign Application Priority Data

Aug. 22, 2018 (JP) ..... JP2018-155392

(51) Int. Cl.
*C25D 3/38* (2006.01)
*C25D 7/12* (2006.01)
(Continued)

(52) U.S. Cl.
CPC ..... *C25D 3/38* (2013.01); *C25D 7/12* (2013.01); *C25D 17/001* (2013.01); *C25D 21/14* (2013.01)

(58) Field of Classification Search
CPC ..... C25D 3/38–40; C25D 21/14; C01G 3/02
See application file for complete search history.

(56) References Cited

U.S. PATENT DOCUMENTS 4,153,753 A * 5/1979 Woodman ..... F24S 70/225
428/409

FOREIGN PATENT DOCUMENTS

JP 2004-269955 A 9/2004
JP 2016-074975 A 5/2016
(Continued)

OTHER PUBLICATIONS

International Patent Application No. PCT/JP2019/029751; Int'l Search Report; dated Sep. 24, 2019; 2 pages.

*Primary Examiner* — Ho-Sung Chung
(74) *Attorney, Agent, or Firm* — BakerHostetler

(57) ABSTRACT

The present invention relates to a copper oxide solid for use in plating of a substrate using an insoluble anode. Further the present invention relates to a method of producing the copper oxide solid. Further the present invention relates to an apparatus for supplying a plating solution in which the copper oxide solid is dissolved into a plating tank. A copper oxide solid (CS) to be supplied into a plating solution for plating a substrate (W) includes a copper oxide powder and a liquid as a binder to solidify the copper oxide powder.

3 Claims, 9 Drawing Sheets

(51) Int. Cl.
*C25D 17/00* (2006.01)
*C25D 21/14* (2006.01)

(56) References Cited

FOREIGN PATENT DOCUMENTS

| | | | |
|---|---|---|---|
| JP | 2017-141503 | A | 8/2017 |
| JP | 2018-062453 | A | 4/2018 |

* cited by examiner

COPPER OXIDE SOLID FOR USE IN PLATING OF A SUBSTRATE, METHOD OF PRODUCING THE COPPER OXIDE SOLID, AND APPARATUS FOR SUPPLYING A PLATING SOLUTION INTO A PLATING TANK

TECHNICAL FIELD

The present invention relates to a copper oxide solid to be fed into a plating solution, and more particularly to a copper oxide solid for use in plating of a substrate using an insoluble anode. Further, the present invention relates to a method of producing the copper oxide solid. Further, the present invention relates to an apparatus for supplying a plating solution in which the copper oxide solid is dissolved into a plating tank.

BACKGROUND ART

In fields of semiconductor devices and print interconnects, there is a trend to use the electroplating technique for performing a so-called bottom-up plating which is to deposit metal preferentially on a bottom of a recess. With a view to performing so-called bottom-up plating, a method of plating a substrate, such as a wafer, while preventing a generation of an electrolyte component which inhibits bottom-up plating is known. This method involves bringing an insoluble anode and a substrate into contact with a copper sulfate plating solution containing additives, and applying a predetermined plating voltage from a plating power source to between the substrate and the insoluble anode to plate the substrate.

in order to replenish a plating solution with objective metal ions in a plating apparatus which uses an insoluble anode as described above, it is conceivable to use a method in which a powdery metal salt is fed into a circulation tank or a method in which metal pieces are dissolved in a separate tank for replenishment. When the powdery metal salt is supplied into a plating solution, fine particles increases in the plating solution and may cause a defect in a surface of a plated substrate. In view of this, a technique which can keep concentrations of components of a plating solution constant over a long period of time in a plating apparatus that uses an insoluble anode has been proposed.

This technique, which involves circulating and reusing a plating solution while recovering the plating solution, can minimize the amount of the plating solution used. Further, the use of an insoluble anode can eliminate the need for replacement of the anode, thereby facilitating maintenance and management of the anode. Furthermore, the concentration of a component(s) of the plating solution, which changes with the circulation and reuse of the plating solution, can be maintained within a certain range by supplying a replenishing solution, containing the plating solution component(s) at a concentration high than the plating solution, to the plating solution.

CITATION LIST

Patent Literature

Patent document 1: Japanese laid-open patent publication No. 2016-74975

Patent document 2: Japanese laid-open patent publication No. 2004-269955

SUMMARY OF INVENTION

Technical Problem

As copper plating of substrates is performed, copper ions in the plating solution decrease. Therefore, it is necessary for a plating-solution supply apparatus to adjust the concentration of the copper ions in the plating solution. One solution to replenish the plating solution with copper is to add copper oxide powder to the plating solution. However, when the powder is dispersed, the powder causes contamination in a clean room.

It is therefore an object of the present invention to provide a soluble copper oxide solid which can be supplied to a plating solution without dispersing. Further, it is an object of the present invention to provide a method of producing the copper oxide solid. Further, it is an object of the present invention to provide an apparatus for supplying a plating solution in which the soluble copper oxide solid is dissolved that can be supplied to the plating solution without dispersing into a plating tank.

Solution to Problem

In an embodiment, there is provided a copper oxide solid to be supplied into a plating solution for plating a substrate, comprising: a copper oxide powder; and a liquid as a binder to solidify the copper oxide powder.

In an embodiment, the liquid is at least one liquid comprising a basic composition liquid of the plating solution.

In an embodiment, the copper oxide solid comprises: an outer portion comprising a surface of the copper oxide solid; and an inner portion located inside the outer portion, and a water content of the outer portion is larger than a water content of the inner portion.

In an embodiment, a surface of the copper oxide solid has a concavo-convex shape.

In an embodiment, there is provided a method of producing a copper oxide solid to be supplied into a plating solution for plating a substrate, comprising: an addition step of adding a liquid to a copper oxide powder; and a compression molding step of compression-molding the copper oxide powder with the liquid added.

In an embodiment, the method further comprising: a first compression molding step of compression-molding the copper oxide powder with a first compressive force, the first compression molding step being performed before the addition step, and wherein the compression molding step of compression-molding the copper oxide powder after the addition step is a second compression molding step of compression-molding the copper oxide powder with a second compressive force.

In an embodiment, the compression molding step is performed using a press mold having a concavo-convex shape.

In an embodiment, there is provided an apparatus for supplying a plating solution dissolving a copper oxide solid into a plating tank, comprising: a dissolution tank configured to dissolve the copper oxide solid to the plating solution; a feeding mechanism configured to feed the copper oxide solid into the dissolution tank; and an agitator configured to agitate the plating solution while feeding the copper oxide solid into the dissolution tank, and wherein the feeding mechanism comprises: a storage case configured to store the copper oxide solid; and an actuator configured to move the copper oxide solid until immerging the copper oxide solid in the storage case into the plating solution in the dissolution tank.

In an embodiment, the storage case comprises: a supply port having a size for the copper oxide solid to pass through; and a communication hole having a size for the actuator to contact the copper oxide solid in the storage case, and wherein the actuator is a push-out device configured to push out the copper oxide solid to the plating solution in the dissolution tank through the communication hole.

In an embodiment, the feeding mechanism comprises an inert-gas supply mechanism configured to supply an inert gas toward the supply port.

In an embodiment, the inert-gas supply mechanism comprises a gas nozzle coupled to the storage case.

Advantageous Effects of Invention

According to the present invention, the copper oxide solid is supplied to the plating solution without dispersing. Therefore, contamination in the clean room due to particles is prevented.

DESCRIPTION OF EMBODIMENTS

Figure 1:
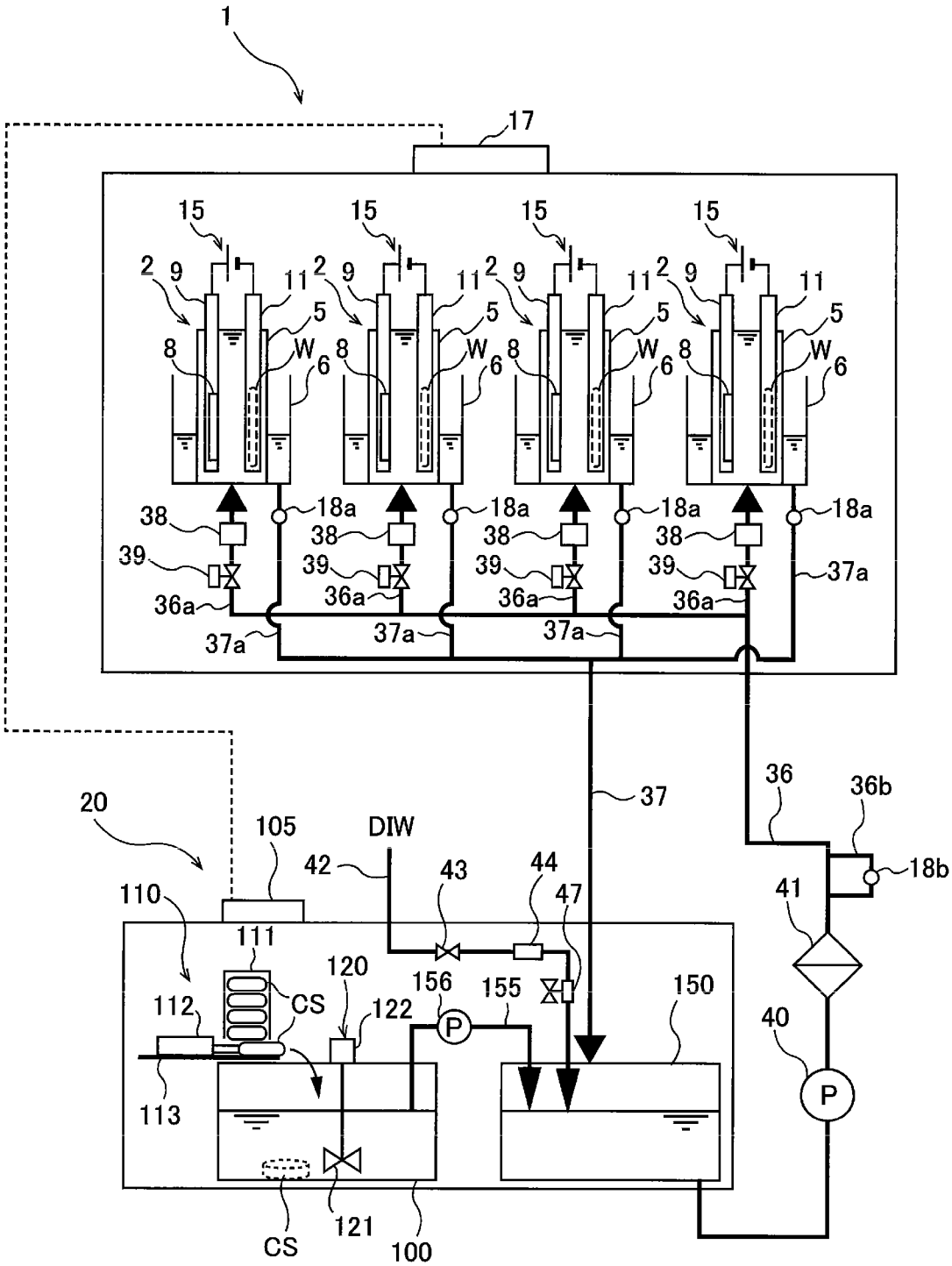
FIG. 1 is a schematic view showing an embodiment of a plating system.

Embodiments will now be described with reference to the drawings. FIG. 1 is a schematic view showing an embodiment of a plating system. The plating system includes a plating apparatus 1 installed in a clean room, and a plating-solution supply apparatus 20. In this embodiment, the plating apparatus 1 is an electroplating unit for electroplating a substrate (e.g., a wafer) with copper, and the plating-solution supply apparatus 20 is a plating-solution supply unit for supplying copper oxide solid into a plating solution to be used in the plating apparatus 1.

The plating apparatus 1 has four plating tanks 2. Each plating tank 2 includes an inner tank 5 and an outer tank 6. An insoluble anode 8, held by an anode holder 9, is disposed in the inner tank 5. Further, in the plating tank 2, a neutral membrane (not shown) is disposed around the insoluble anode 8. The inner tank 5 is filled with a plating solution, which is allowed to overflow the inner tank 5 into the outer tank 6. The inner tank 5 is also provided with an agitation paddle (not shown) comprised of a rectangular plate-like member having a constant thickness, made of a resin such as PVC, PP or PTFE, or a metal, such as stainless steel or titanium, coated with a fluororesin or the like. The agitation paddle reciprocates parallel to a substrate W to agitate the plating solution, so that sufficient copper ions and additives can be supplied uniformly to a surface of the substrate W.

The substrate W, such as a wafer, is held by a substrate holder 11 and is immersed, together with the substrate holder 11, in the plating solution held in the inner tank 5 of the plating tank 2. The substrate W, as an object to be plated, may be a semiconductor substrate, a printed circuit board, etc. In the case of using a semiconductor substrate as the substrate W, the semiconductor substrate is flat or substantially flat (a substrate having a groove(s), a tube(s), a resist pattern(s), etc. is herein regarded as substantially flat). When plating such a flat object, it is necessary to control a plating condition over time in consideration of the in-plane uniformity of a plating film formed on the substrate, while preventing a deterioration in the quality of the film.

The insoluble anode 8 is electrically connected via the anode holder 9 to a positive pole of a plating power source 15, while the substrate W held by the substrate holder 11 is electrically connected via the substrate holder 11 to a negative pole of the plating power source 15. When a voltage is applied from the plating power source 15 between the insoluble anode 8 and the substrate W that are both immersed in the plating solution, an electrochemical reaction occurs in the plating solution held in the plating tank 2, whereby copper is deposited on the surface of the substrate W. In this manner, the surface of the substrate W is plated with copper. The plating apparatus 1 may have less than four or more than four plating tanks 2.

The plating apparatus 1 includes a plating controller 17 for controlling the plating process of the substrate W. The plating controller 17 has a function of calculating a concentration of copper ions contained in the plating solution in each plating tank 2 from a cumulative value of electric current that has flowed in the substrate W. Copper in the plating solution is consumed as the substrate W is plated. The consumption of copper is proportional to the cumulative value of electric current that has flowed in the substrate W. The plating controller 17 can therefore calculate the copper ion concentration in the plating solution in each plating tank 2 from the cumulative value of electric current.

Figure 2:
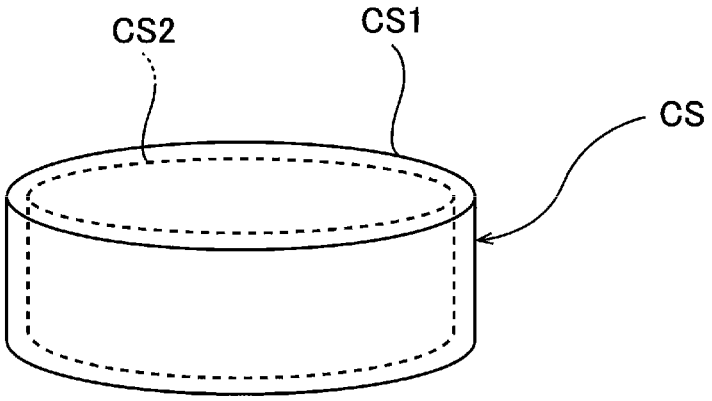
FIG. 2 is a perspective view showing an embodiment of a copper oxide solid to be supplied to a plating solution.

FIG. 2 is a perspective view showing an embodiment of a copper oxide solid CS to be supplied to the plating solution. The copper oxide solid CS in this embodiment includes a copper oxide powder and a liquid as a binder to solidify the copper oxide powder. An average particle size of the copper oxide powder is in the range of 10 micrometers to 200 micrometers, preferably in the range of 20 micrometers to 100 micrometers, more preferably in the range of 30 micrometers to 50 micrometers. If the average particle size is too small, the powder is likely to scatter as dust. On the other hand, if the average particle size is too large, the solubility of the powder, when fed into a plating solution, may be poor.

In this embodiment, the copper oxide powder containing a concentration of 20 ppm of sodium (Na) is used. In one embodiment, a concentration of copper (Cu) in the copper oxide powder is not less than 70 percent by weight. Allowable impurities contained in the copper oxide powder include Fe (iron) at a concentration of less than 10 ppm, Na (sodium) at a concentration of less than 20 ppm, Ca (calcium) at a concentration of less than 5 ppm, Zn (zinc) at a concentration of less than 20 ppm, Ni (nickel) at a concentration of less than 5 ppm, Cr (chromium) at a concentration of less than 5 ppm, As (arsenic) at a concentration of less than 5 ppm, Pb (lead) at a concentration of less than 5 ppm, Cl (chlorine) at a concentration of less than 10 ppm, and Ag (silver) at a concentration of less than 5 ppm.

Techniques of analyzing the impurities in the copper oxide powder include an electron probe micro analyzer (EPMA) and X-ray fluorescence analyzer (XRF), both of which being capable of analyzing a specimen in a solid state, and inductively coupled plasma atomic emission spectroscopy (ICP-AES) for analyzing a dissolved powder in water.

In this embodiment, the liquid added to the copper oxide powder is at least one liquid comprising a basic composition liquid (VMS: Virgin Makeup Solution) of the plating solution to which no additives have been added. More specifically, the liquid to be added is a liquid containing at least one of pure water (DIW), sulfuric acid ($H_2SO_4$), and hydrochloric acid (HCl). The reason for this is as follows. Since the copper oxide solid CS is supplied to the plating solution, if the liquid contained in the copper oxide solid CS is a liquid other than components of the plating solution, this liquid, as an impurity, may adversely affect the quality of the plating. In this embodiment, such a problem does not occur.

An acidic copper sulfate plating solution containing sulfuric acid, copper sulfate, halogen ions, and organic additives, in particular a plating accelerator e.g. comprising SPS (bis(3-sulfopropyl) disulfide), a suppressor e.g. comprising PEG (polyethylene glycol) and a leveler e.g. comprising PEI (polyethylenimine), may be used as the plating solution. Chloride ions are preferably used as the halogen ions.

As shown in FIG. 2, the copper oxide solid CS has a cylindrical shape and includes an outer portion CS1 which includes a surface of the copper oxide solid CS and an inner portion CS2 which is located inside the outer portion CS1. A shape of the copper oxide solid CS is not limited to this embodiment, but the shape is preferably a shape that is not easily damaged (cracked or chipped). In FIG. 2, the outer portion CS1 and the inner portion CS2 are depicted in the abstract. The relationship between a size of the outer portion CS1 and a size of the inner portion CS2 is not limited to the embodiment shown in FIG. 2. In one embodiment, the outer portion CS1 may be only the surface of the copper oxide solid CS.

Figure 3:
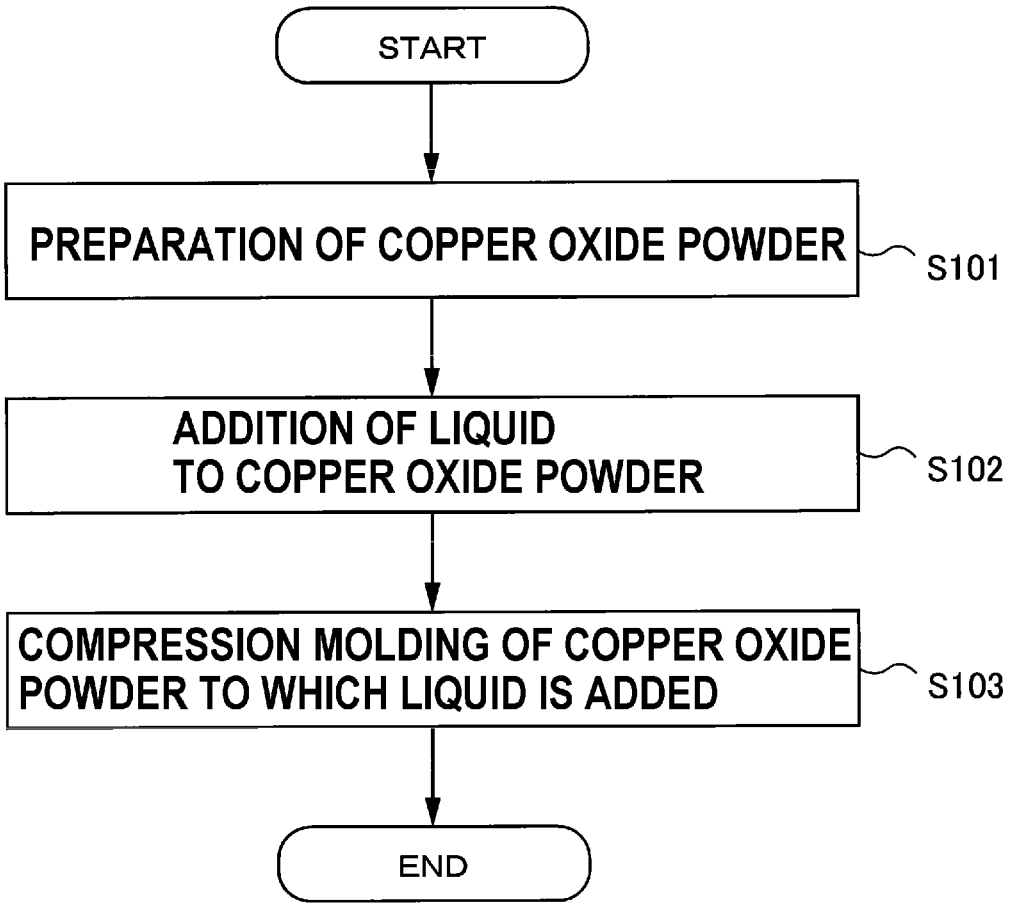
FIG. 3 is a view showing an embodiment of a method of producing the copper oxide solid.

FIG. 3 is a view showing an embodiment of a method of producing the copper oxide solid CS. As shown in step S101 of FIG. 3, first, a copper oxide powder is prepared. Next, as shown in step S102 of FIG. 3, a liquid as a binder is added to the copper oxide powder (addition step). Although not shown, in order to uniformly mix the copper oxide powder and the liquid, the copper oxide powder and the liquid may be kneaded (kneading step). Thereafter, as shown in step S103 of FIG. 3, the copper oxide powder to which the liquid is added is compression-molded by a press machine (not shown) (compression molding step). In this manner, the copper oxide solid CS is produced through steps S101 to S103.

Experimental results of a strength of the copper oxide solid produced through the above steps will be described. 2 grams of pure water (DIW) is added to 10 grams of copper oxide powder, and the copper oxide powder and pure water are kneaded. A mixture of copper oxide powder and pure water is filled into a press mold having a diameter of 30 mm and a depth of 20 mm. A press machine applies a pressure (compressive force) of 0.3 tons to this mixture. This pressurized state is maintained for a predetermined time to compress-mold the mixture. An average particle size of the copper oxide powder used in this experiment is 50 micrometers.

A weight of the liquid (pure water) with respect to a weight of the copper oxide powder in this experiment is 20 percent by weight, but the weight of the liquid with respect to the weight of the copper oxide powder is not limited to this embodiment. Preferably, the weight of the liquid relative to the weight of the copper oxide powder is in the range of 5 to 30 percent by weight, more preferably in the range of 15 to 25 percent by weight.

The copper oxide solid produced in this experiment has a strength that does not crack even when a force of 50 N applies to its surface. Further, the copper oxide solid has the strength that does not easily break even when the copper oxide solid is freely dropped from a height of 300 mm. Therefore, the copper oxide solid is not damaged in its transport path. In this experiment, even when the copper oxide solid is dried in a furnace at 65° C. for 1 hour, cracking of the copper oxide solid due to drying does not occur. Therefore, in one embodiment, the method of producing may include a drying step of drying the compression molded copper oxide solid after step S103 of FIG. 3.

Experimental results of dissolution of the copper oxide solid produced in this experiment will be described. The copper oxide solid is dissolved under two conditions, that is, a chemical solution in which the copper oxide solid is immersed is agitated and the chemical solution is not agitated. The chemical solution is 10 percent dilute sulfuric acid, and a temperature of the chemical solution is the same as room temperature. The volume of the chemical solution is 1000 milliliters. The agitating speed (rotational speed) is 150 [$min^{-1}$].

When the copper oxide solid is dissolved without agitating the chemical solution, the copper oxide solid is dissolved by about 10 percent after 5 minutes. On the other hand, when the chemical solution is agitated to dissolve the copper oxide solid, the copper oxide solid is dissolved immediately after a start of agitating, and after 3 to 4 minutes, about 95 percent is dissolved.

As can be seen from these experimental results, the copper oxide solid CS according to this embodiment has a strength that does not break even when it is transported, and has a solubility that easily dissolves under the agitating condition. Therefore, the copper oxide solid CS can be supplied to the plating solution without being scattered in its transport path. As a result, contamination of the clean room by particles (copper oxide powder) is prevented.

Further, the copper oxide solid CS according to this embodiment can exert the following effects. In order to improve a quality of plating of the substrate W, it is required to surely add a necessary amount (specified amount) of copper oxide to the plating solution. However, when copper oxide is a powder, the powder may scatter and the amount of powder supplied may be less than the specified amount. More specifically, the powder scatters from leaving a hopper until it is fed into the liquid (plating liquid) in a dissolution tank, and in some cases, with an action of static electricity, the powder may also adhere to an inner wall of the dissolution tank and surfaces of other supply apparatuses. As a result, not all of the copper oxide can be reliably supplied to the plating solution. According to this embodiment, the copper oxide supplied to the plating solution is the copper oxide solid CS having a specified amount. Therefore, there is no problem that the supply amount of copper oxide to the plating solution is less than the specified amount due to the cause of scattering and/or static electricity.

Figure 4:
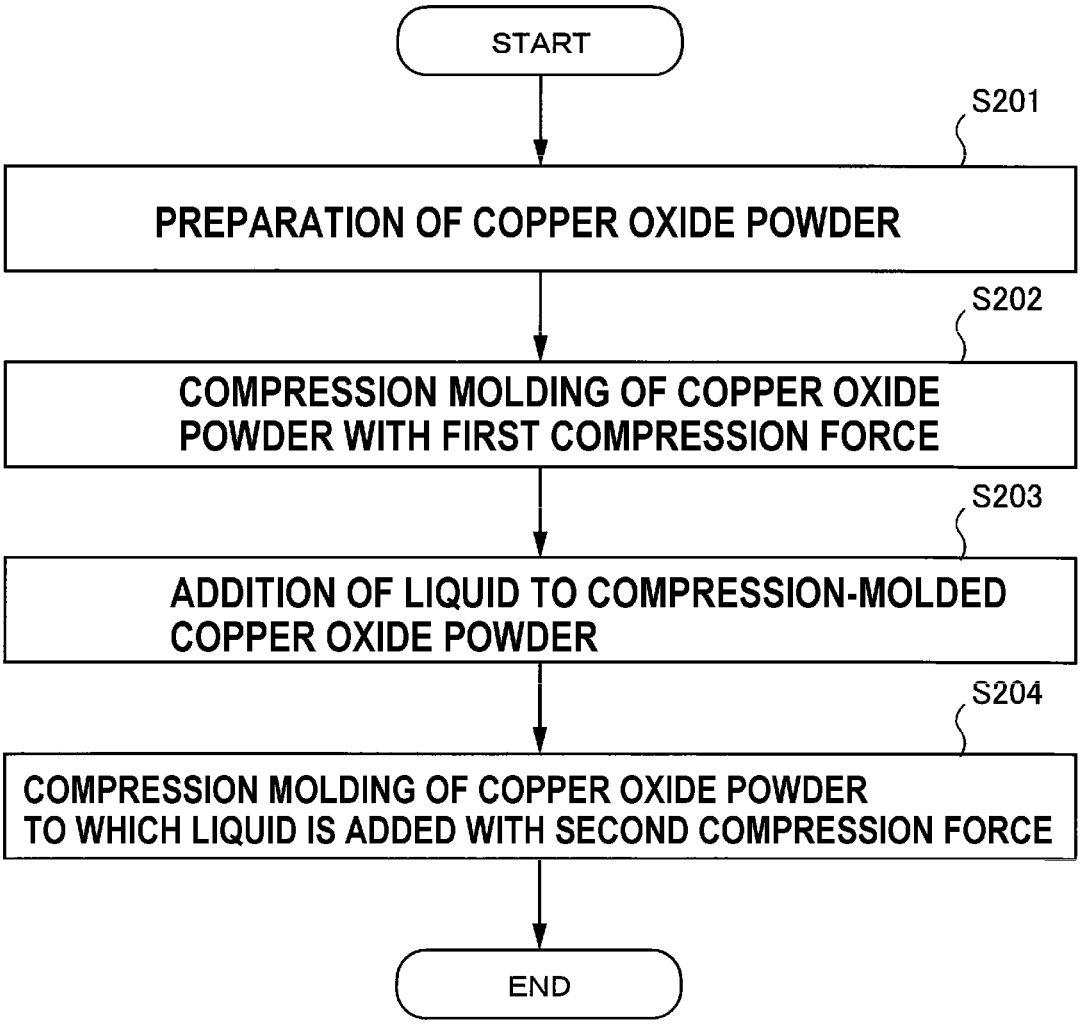
FIG. 4 is a view showing another embodiment of the method of producing the copper oxide solid.

In order to improve a surface strength of the copper oxide solid CS, in one embodiment, the method of producing may further includes a compression molding step as a pre-step. FIG. 4 is a view showing another embodiment of the method of producing the copper oxide solid CS. As shown in step S201 of FIG. 4, first, the copper oxide powder is prepared. Next, as shown in step S202 of FIG. 4, the copper oxide powder is compression-molded with a first compressive force (pressure) (first compression molding step).

In this first compression molding step, the copper oxide powder is compression-molded with or without adding the liquid to the copper oxide powder. Thereafter, the liquid is added to the compression-molded copper oxide powder (see step S203 of FIG. 4). In this step S203, the liquid is supplied to the surface (outer portion CS1) of the compression-molded copper oxide powder. In other words, the surface of the copper oxide powder, which is a molded product, is humidified by means such as spraying. By such humidification, moisture can be attached between the particles of the copper oxide powder, and a binding force between the particles can be strengthened. Thereafter, as shown in step S204 of FIG. 4, the copper oxide powder whose surface has been humidified is compression-molded with a second compressive force (pressure) (second compression molding step).

In this embodiment, the second compressive force is the same as or less than the first compressive force. In one embodiment, the second compressive force may be greater than the first compressive force. When the liquid is added to the copper oxide powder in step S202 of FIG. 4, the liquid used in step S202 and the liquid used in step S203 may be different or the same type of liquid.

In the copper oxide solid CS produced through steps S201 to S204, a water content of the outer portion CS1 and a water content of the inner portion CS2 are different. More specifically, the water content of the outer portion CS1 is larger than the water content of the inner portion CS2. Therefore, the copper oxide solid CS has a higher surface strength. As a result, a generation of the particles (copper oxide powder) due to a collapse of the surface of the copper oxide solid CS is prevented. In one embodiment, the method of producing may include a drying step of drying the compression molded copper oxide solid after step S204 of FIG. 4. By this drying step, a moisture of the outer portion CS1 of the copper oxide solid CS evaporates, and the outer portion CS1 of the copper oxide solid CS becomes harder. As a result, the scattering of the particles from the copper oxide solid CS can be suppressed. Since the inner portion CS2 of the copper oxide solid CS has a looser bond between the particles than that of the outer portion CS1, the copper oxide solid is easily dissolved in the liquid.

In order to further improve a solubility of the copper oxide solid CS, in one embodiment, the surface of the copper oxide solid CS may have a concavo-convex shape. The copper oxide solid CS having the concavo-convex shape is produced by filling the copper oxide solid into a press mold having a concavo-convex shape on a contact surface with the copper oxide powder. A surface area of the copper oxide solid CS having such a shape increases, and a contact area of the copper oxide solid CS with the plating solution increases. Therefore, the solubility of the copper oxide solid CS in the plating solution is further improved. If the surface area of the copper oxide solid CS can be increased, the copper oxide solid CS may have a shape other than the concavo-convex shape.

Configurations of the plating-solution supply apparatus 20 will be described with reference to FIG. 1. The plating-solution supply apparatus 20 is an apparatus for supplying the plating solution in which the copper oxide solid CS is dissolved into the plating tank 2. The plating-solution supply apparatus 20 includes a dissolution tank 100 for dissolving the copper oxide solid CS in the plating solution, a feeding mechanism 110 for feeding the copper oxide solid CS into the dissolution tank 100, and an agitator 120 for agitating the plating solution together with the copper oxide solid CS fed into the dissolution tank 100.

The feeding mechanism 110 includes a storage case 111 for housing the copper oxide solid CS and an actuator 112 for moving the copper oxide solid CS until the copper oxide solid CS in the storage case 111 is immersed in the dissolution tank 100. The actuator 112 is connected to an operation controller 105. The operation controller 105 is configured to operate the actuator 112 to move the copper oxide solid CS in the storage case 111 to the plating solution in the dissolution tank 100.

The storage case 111 and the actuator 112 are supported on a supporter 113 disposed above the dissolution tank 100 (more specifically, above the plating solution in the dissolution tank 100). In this embodiment, the actuator 112 can, by its operation, cause the copper oxide solid CS stored in the storage case 111 on the supporter 113 to fall into the plating solution held in the dissolution tank 100.

Figure 5:
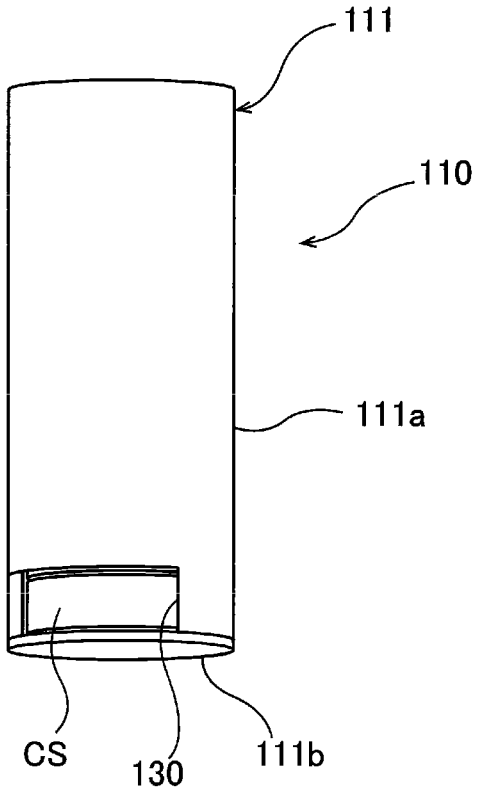
FIG. 5 is a perspective view of a storage case.
Figure 6:
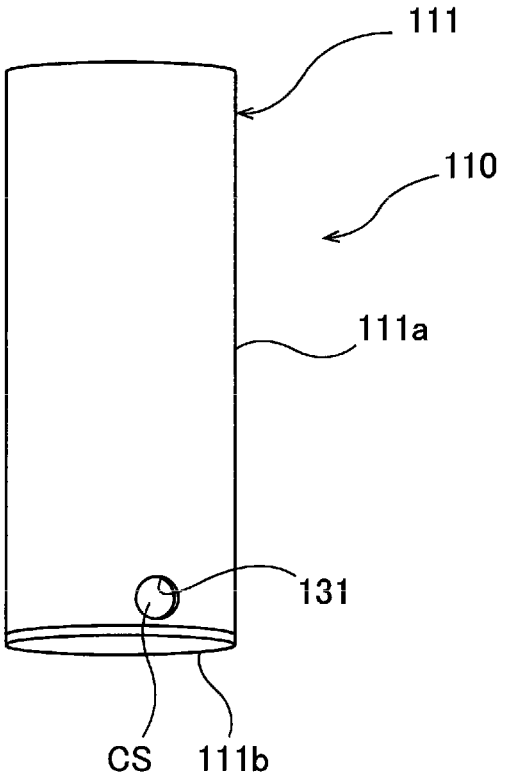
FIG. 6 is a perspective view of the storage case.
Figure 7:
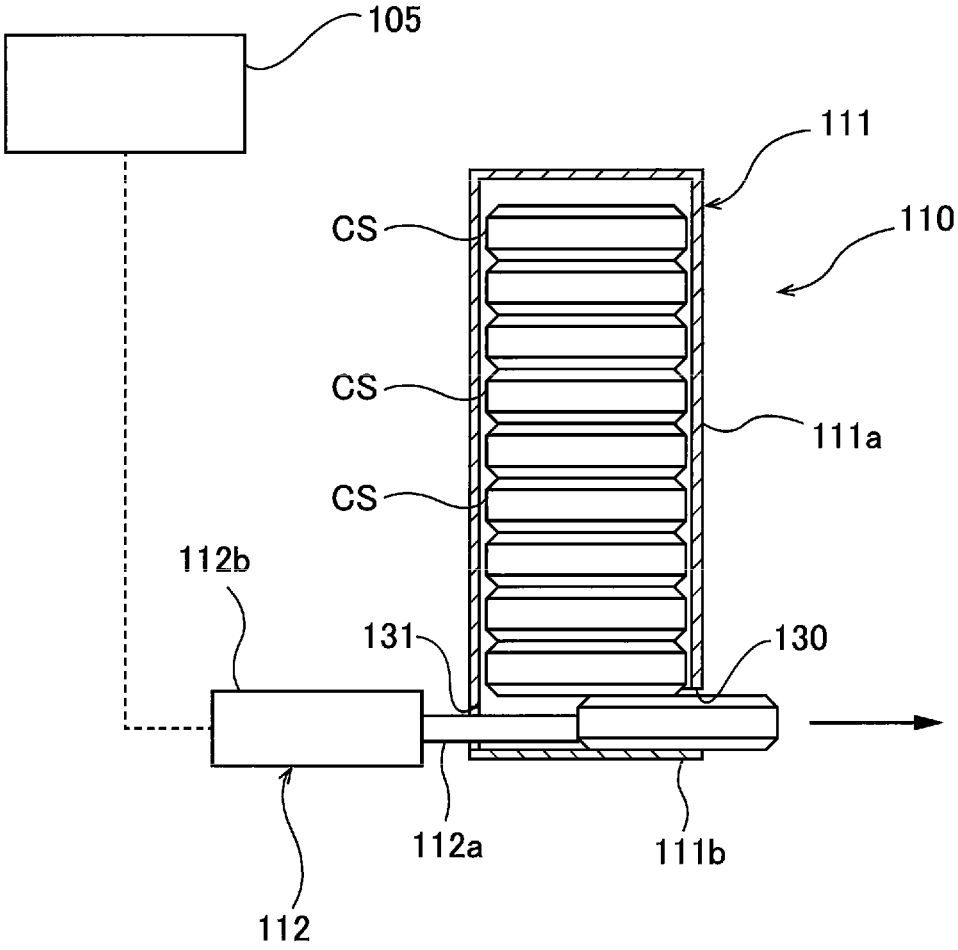
FIG. 7 is a longitudinal cross-sectional view of the storage case.

FIGS. 5 and 6 are perspective views of the storage case 111. FIG. 7 is a longitudinal cross-sectional view of the storage case 111. As shown in FIGS. 5 to 7, the storage case 111 includes a supply port 130 having a size for the copper oxide solid CS to pass through and a communication hole (push hole) 131 having a size for the actuator 112 to contact the copper oxide solid CS in the storage case 111.

The storage case 111 includes a cylindrical body portion 111*a* having an inner diameter larger than a diameter of the copper oxide solid CS and a lid portion 111*b* that closes an end-side opening of the body portion 111*a*. The copper oxide solid CS is filled into the body portion 111*a*, and is stored in the storage case 111 by closing the lid portion 111*b*. When the copper oxide solid CS is not used, the supply port 130 and the communication hole 131 are sealed with a sealing member (not shown), such as a cap or tape. The sealing member is removed when the storage case 111 is set. In this embodiment, a plurality of copper oxide solids CS are stored in the storage case 111, but the number of copper oxide solids CS stored in the storage case 111 is not limited to this embodiment.

The supply port 130 and the communication hole 131 are formed in a lower part of the body portion 111*a*, and face each other. In this embodiment, the actuator 112 is an push-out device (e.g., an air cylinder) that pushes out the copper oxide solid CS to the plating solution in the dissolution tank 100 through the communication hole 131.

A case where the actuator 112 is an air cylinder will be described below. As shown in FIG. 7, the actuator 112 includes a piston rod 112*a* capable of contacting the copper oxide solid CS in the storage case 111 through a communication hole 131 and a cylinder body 112*b* housing the piston rod 112*a*.

When the operation controller 105 operates the actuator 112, the piston rod 112*a* collides with the copper oxide solid CS through the communication hole 131 and pushes the copper oxide solid CS through the supply port 130 to the outside of the storage case 111.

In this embodiment, since the storage case 111 is disposed above the dissolution tank 100, the extruded copper oxide solid CS slides on the supporter 113 to fall into the dissolution tank 100. In this manner, the copper oxide solid CS is fed into the plating solution in the dissolution tank 100.

Figure 8:
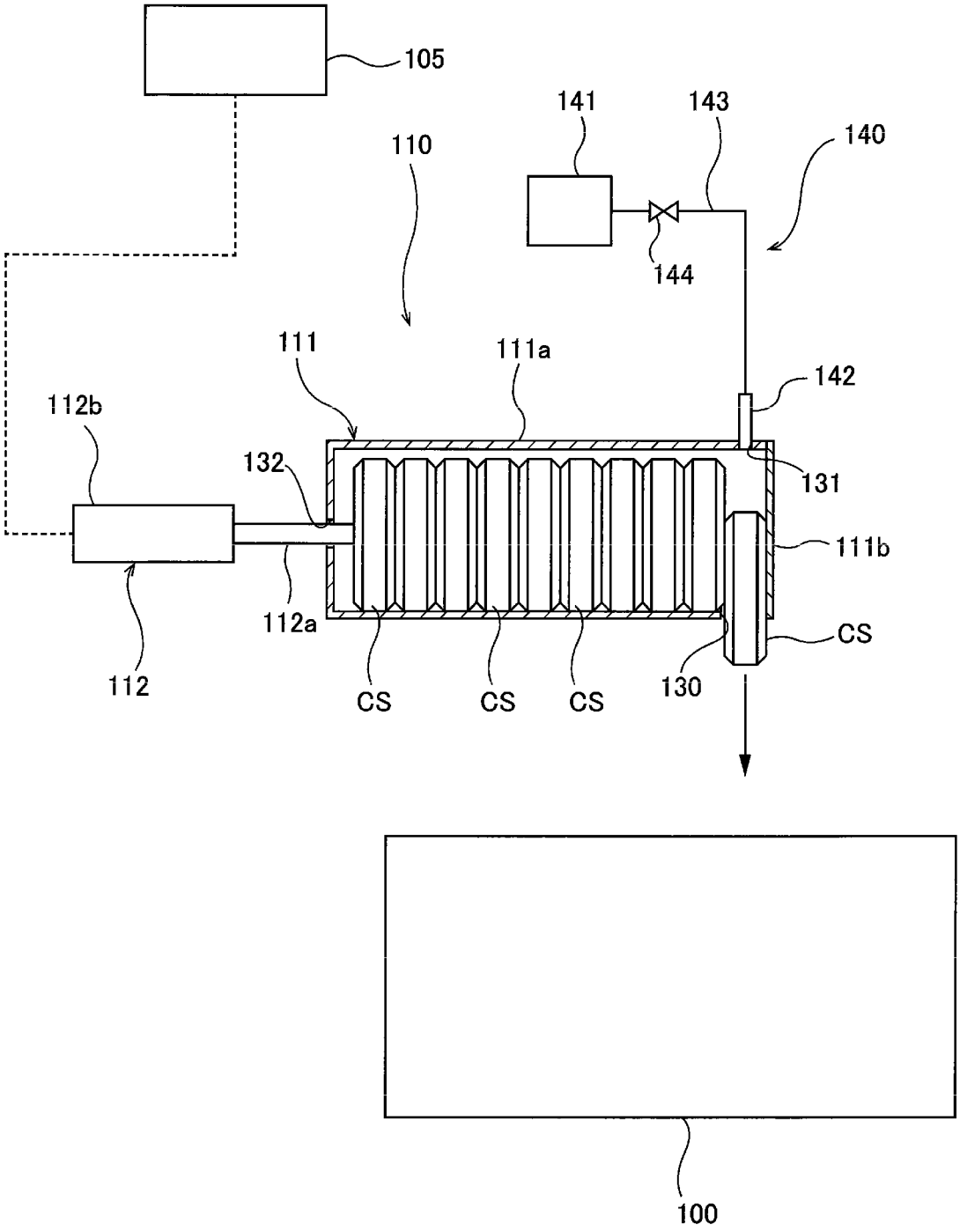
FIG. 8 is a view showing the storage case arranged horizontally.

In the above-described embodiment, the storage case 111 is arranged vertically, but the storage case 111 may be arranged horizontally. FIG. 8 is a view showing the storage case 111 arranged horizontally. As shown in FIG. 8, the storage case 111 is disposed so that the supply port 130 faces downward (more specifically, a surface of the liquid in the dissolution tank 100). Although not shown, the storage case 111 and the actuator 112 are supported on a supporter 113 (see FIG. 1).

A communication hole (push hole) 132 having a size that allows the actuator 112 to contact the copper oxide solid CS in the storage case 111 is formed on an opposite side of the body portion 111*a* against the lid portion 111*b*. This commutation hole 132 serves the same role as the commutation hole 131 described in the above-described embodiment. Therefore, the piston rod 112*a* of the actuator 112 can move the copper oxide solid CS in the storage case 111 toward the lid portion 111*b* until the copper oxide solid CS in the storage case 111 falls into the plating solution in the dissolution tank 100 through the communication hole 132.

The solubility of the copper oxide is dependent on a temperature of the plating solution. Therefore, as one of the purposes of dissolving the copper oxide solid CS more effectively in the plating solution, the plating solution in the dissolution tank 100 may be used in a heated state. The temperature of the plating solution is preferably in the range of 10° C. to 50° C., and more preferably in the range of 20° C. to 45° C.

If the storage case 111 is located above the dissolution tank 100, a steam generated from the high-temperature plating solution may enter the storage case 111 through the supply port 130. As a result, adjacent copper oxide solids CS may adhere to each other due to the steam entering the storage case 111. Therefore, as shown in FIG. 8, the feeding mechanism 110 may include an inert-gas supply mechanism 140 for supplying an inert gas, such as nitrogen gas ($N_2$ gas), toward the supply port 130 of the storage case 111. The inert gas supply mechanism 140 is configured to prevent steam from entering the supply port 130.

The inert-gas supply mechanism 140 includes a gas supply source 141, a gas nozzle 142 coupled to the storage case 111, and a coupling line 143 coupling the gas supply source 141 and the gas nozzle 142. In this embodiment, the gas nozzle 142 is coupled to the communication hole 131 of the storage case 111.

When the inert gas is supplied from the gas supply source 141 to the gas nozzle 142 through the coupling line 143, the inert gas is injected toward the supply port 130. Since a tip of the gas nozzle 142 faces the supply port 130, the inert gas can prevent entering of the steam from the supply port 130. The gas nozzle 142 may be coupled to a hole (not shown) different from the communication hole 131 formed in the storage case 111 as long as an injection port of the gas nozzle 142 is arranged so as to face the supply port 130, and the gas nozzle 142 may be arranged outside the storage case 111. An on-off valve 144 is attached to the coupling line 143.

The actuator 112 is not limited to the above-described embodiment as long as the copper oxide solid CS can be moved until the copper oxide solid CS in the storage case 111 is immersed in the plating solution. Other embodiments of the actuator 112 will be described.

Figure 9:
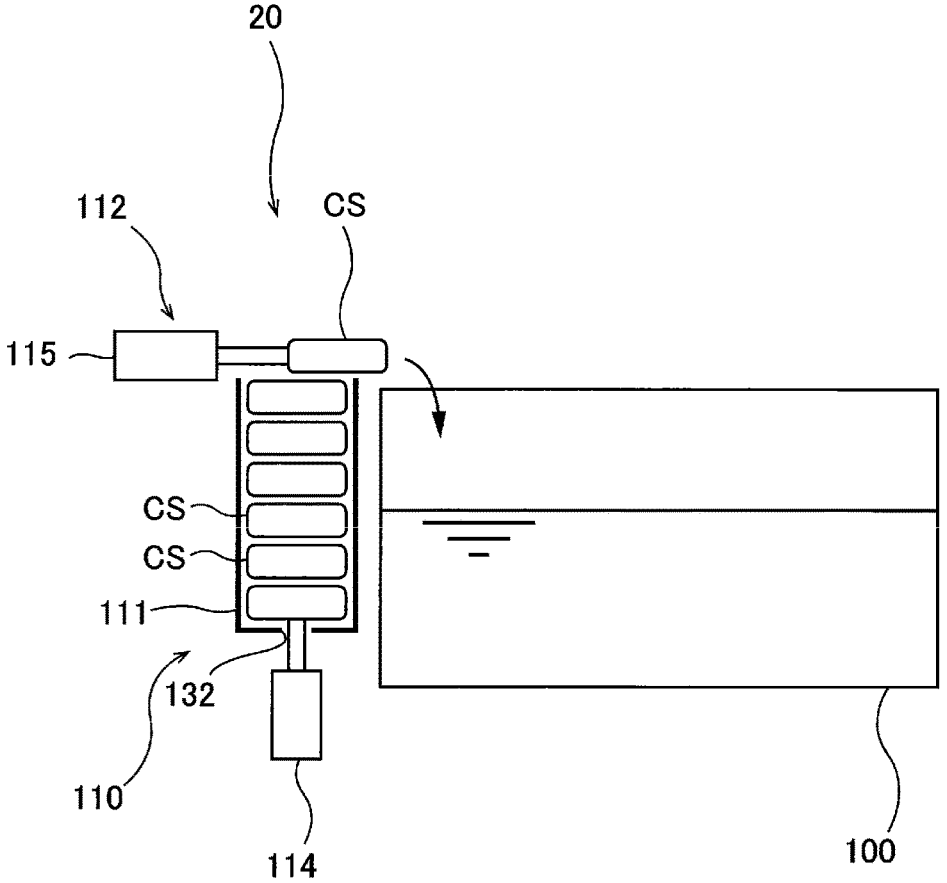
FIG. 9 is a view showing another embodiment of an actuator.

FIG. 9 is a view showing another embodiment of the actuator 112. With reference to the constructions of this embodiment which are the same as those of the above-described embodiment, a duplicate description thereof will be omitted. In FIG. 9, elements other than the feeding mechanism 110 and the dissolution tank 100 are not shown. As shown in FIG. 9, the storage case 111 is arranged adjacent to the dissolution tank 100. The actuator 112 includes a push-up device (e.g., air cylinder) 114 which pushes up the copper oxide solid CS in the storage case 111 above the storage case 111, and a push-out device 115 (e.g., air cylinder) that pushes out the copper oxide solid CS pushed up by the push-up device 114 toward the dissolution tank 100. The push-up device 114 and the push-out device 115 are connected to the operation controller 105.

The push-up device 114 is located below the storage case 111. The push-out device 115 is arranged at a position higher than the storage case 111. In FIG. 9, the lid portion 111*b* of the storage case 111 is not drawn, but the storage case 111 may include the lid portion 111*b*. In this embodiment, the copper oxide solid CS in the storage case 111 is not affected by the steam generated from the high-temperature plating solution in the dissolution tank 100.

Figure 10:
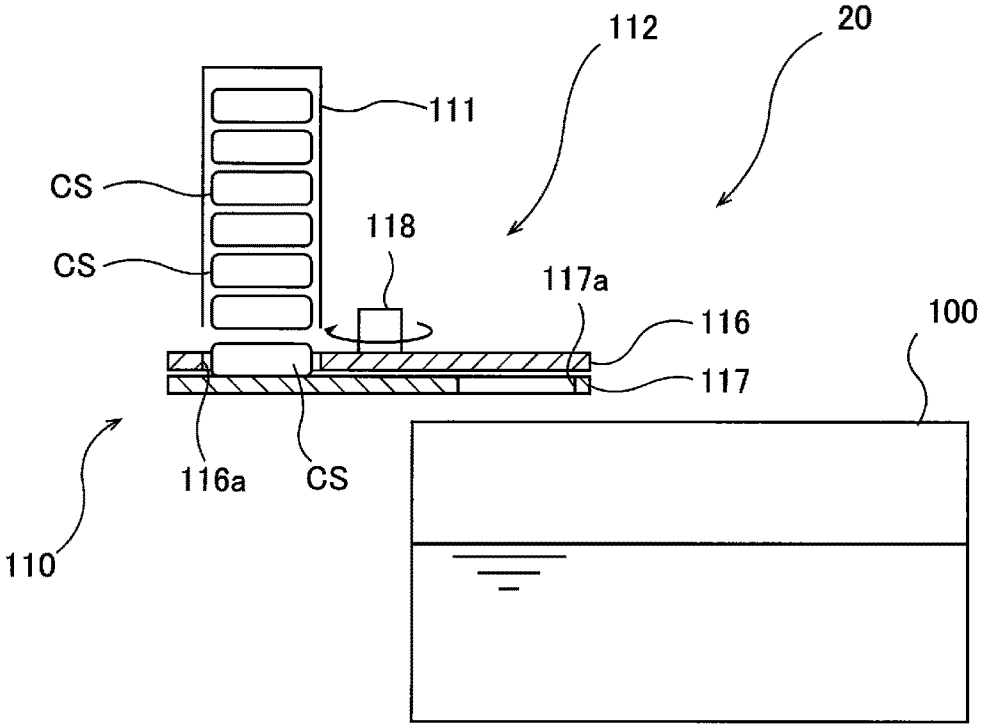
FIG. 10 is a view showing still another embodiment of the actuator.
Figure 11:
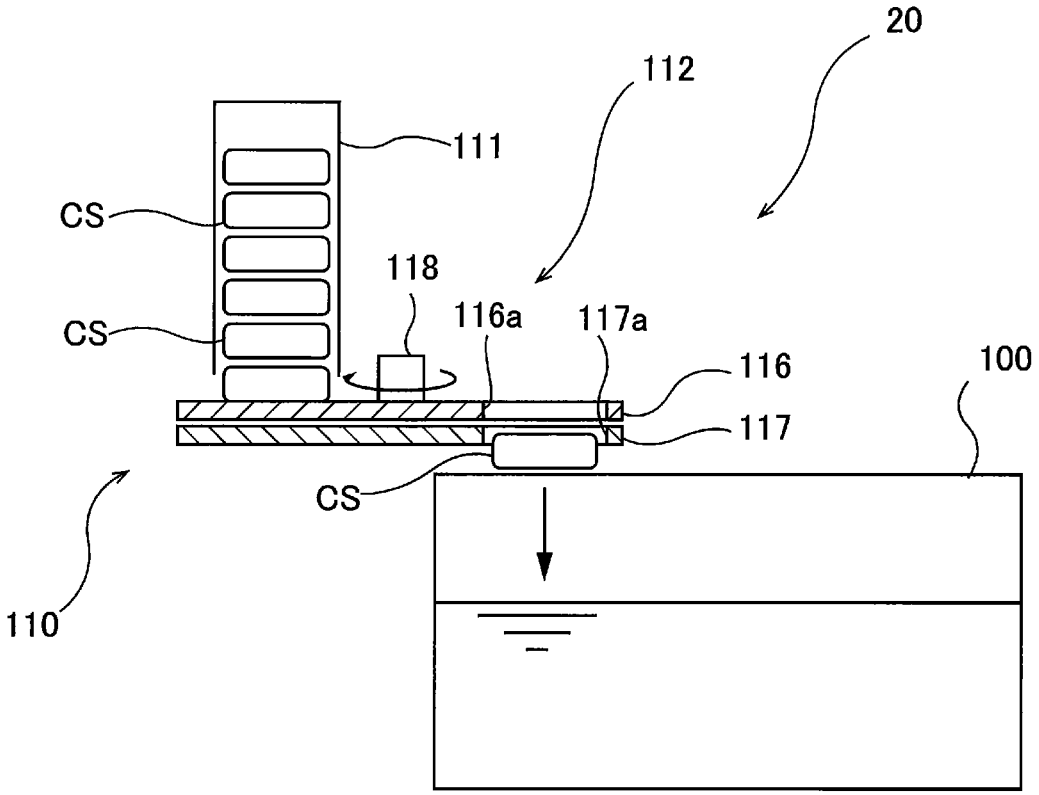
FIG. 11 is a view showing still another embodiment of the actuator.

FIGS. 10 and 11 are views showing still another embodiment of the actuator 112. With reference to the constructions of this embodiment which are the same as those of the above-described embodiment, a duplicate description thereof will be omitted. In FIGS. 10 and 11, elements other than the feeding mechanism 110 and the dissolution tank 100 are not shown. As shown in FIGS. 10 and 11, the storage case 111 does not include a lid portion 111*b*. The actuator 112 includes an upper-side disk member 116 and a lower-side disk member 117 arranged so as to overlap each other vertically, and a motor 118 that rotates the upper-side disk member 116 around its axis. The motor 118 is connected to the operation controller 105.

The storage case 111 is arranged directly above the upper-side disk member 116. The upper-side disk member 116 has an upper-side coupling hole 116*a* having a diameter larger than that of the copper oxide solid CS. The lower-side disk member 117 has a lower-side coupling hole 117*a* having a diameter larger than that of the copper oxide solid CS. The lower-side coupling hole 117*a* is arranged above the dissolution tank 100.

When the motor 118 is driven, the upper-side coupling hole 116*a* rotates around the axis of the upper-side disk member 116. Since a gap is formed between the upper-side disk member 116 and the lower-side disk member 117, the lower-side disk member 117 does not rotate together with the upper-side disk member 116. The upper-side coupling hole 116*a* can be aligned with the lower-side coupling hole 117*a* by rotating the upper-side disk member 116.

The copper oxide solid CS in the storage case 111 falls on the upper-side disk member 116. When the upper-side disk member 116 is rotated by the motor 118, the copper oxide solid CS enters the upper-side coupling hole 116*a*. At this time, the copper oxide solid CS is supported by the lower-side disk member 117. Thereafter, when the upper-side disk member 116 further rotates, the copper oxide solid CS moves on the lower-side disk member 117 in a state of being inserted into the upper-side coupling hole 116*a*. The upper-side coupling hole 116*a* is aligned with the lower-side coupling hole 117*a* by moving the upper-side coupling hole 116*a* in the circumferential direction of the upper-side coupling hole 116*a*. As a result, the copper oxide solid CS falls into the plating solution in the dissolution tank 100.

Configurations of the agitator 120 will be described with reference to FIG. 1. As shown in FIG. 1, the agitator 120 includes an agitation paddle 121 arranged inside the dissolution tank 100 and a motor 122 coupled to the agitation paddle 121. The motor 122 can dissolve the copper oxide solid CS in the plating solution by rotating the agitation paddle 121. Operations of the motor 122 are controlled by the operation controller 105.

The agitator 120 is not limited to a combination of the agitation paddle 121 and the motor 122. In one embodiment, the agitator 120 may be a bubbling mechanism for supplying an inert gas (e.g., $N_2$ gas) to the plating solution in the dissolution tank 100 (not shown). The bubbling mechanism as the agitator 120 includes a bubbling structure having a large number of spouts. When the inert gas is supplied to the bubbling structure through a gas supply line coupled to the bubbling structure, a large number of bubbles are formed in the plating solution. As a result, the plating solution is agitated by the bubbles and the copper oxide solid CS is dissolved. In another embodiment, the agitator 120 may be a throw-in oscillator (not shown). In yet another embodiment, the agitator 120 may be a circulation line that circulates the liquid inside the dissolution tank 100. The circulation line can circulate the liquid in the dissolution tank 100 to agitate the liquid.

As shown in FIG. 1, the plating-solution supply apparatus 20 includes a plating-solution tank (buffer tank) 150 coupled to the dissolution tank 100 and a plating-solution supply line 155 coupling the dissolution tank 100 and the plating-solution tank 150. A pump 156 for transporting the plating solution is provided to the plating-solution supply line 155. The plating solution in the dissolution tank 100 is supplied to the plating-solution tank 150 through the plating-solution supply line 155 by driving the pump 156.

The plating apparatus 1 and the plating-solution supply apparatus 20 are connected by a plating-solution supply tube 36 and a plating-solution return tube 37. More specifically, the plating-solution supply pipe 36 extends from the plating-solution tank 150 to a bottom of the inner tank 5 of the plating tank 2. The plating-solution supply pipe 36 is branched into four branch pipes 36*a*, and the four branch pipes 36*a* are connected to the bottoms of the inner tanks 5 of the four plating tanks 2, respectively. A flow meter 38 and a flow control valve 39 are provided in each of the four branch pipes 36*a*, and the flow meter 38 and the flow control valve 39 are connected to the plating controller 17.

The plating controller 17 is configured to control a degree of opening of the flow control valve 39 based on a flow rate of the plating solution measured by the flow meter 38. Therefore, the flow rate of the plating solution supplied to each plating tank 2 via the four branch pipes 36*a* is controlled by each flow control valve 39 provided on an upstream side of each plating tank 2, and these flow rates are substantially equal to each other. The plating-solution return pipe 37 extends from a bottom of the outer tank 6 of the plating tank 2 to the plating-solution tank 150. The plating-solution return pipe 37 has four discharge pipes 37*a* connected to the bottoms of the outer tanks 6 of the four plating tanks 2.

A pump 40 for transporting the plating solution and a filter 41 arranged on a downstream side of the pump 40 is provided to the plating-solution supply pipe 36. The plating solution used in the plating apparatus 1 is sent to the plating-solution supply apparatus 20 through the plating-solution return tube 37. The plating solution to which the copper oxide powder is added in the plating-solution supply apparatus 20 passes through the plating-solution supply tube 36 to send to the plating apparatus 1. The pump 40 may constantly circulate the plating solution between the plating apparatus 1 and the plating-solution supply apparatus 20, or intermittently supply a predetermined amount of the plating solution from the plating apparatus 1 to the plating-solution supply apparatus 20. The plating solution to which the copper oxide powder is added may be intermittently returned from the plating-solution supply apparatus 20 to the plating apparatus 1.

In order to replenish the plating solution with pure water (DIW), a pure-water supply line 42 is connected to the plating-solution tank 150. This pure-water supply line 42 is provided with an on-off valve 43 (which is usually open) for stopping the supply of pure water when the operation of the plating apparatus 1 is stopped, a flow meter 44 for measuring a flow rate of the pure water, and a flow control valve 47 for controlling a flow rate of the pure water. The flow meter 44 and the flow control valve 47 are connected to the plating controller 17. The plating controller 17 is configured to control a degree of opening of the flow control valve 47 to supply the pure water into the plating-solution tank 150 in order to dilute the plating solution when the copper ion concentration in the plating solution has exceeded an upper limit of a predetermined management range.

The plating controller 17 is coupled to the operation controller 105 of the plating-solution supply apparatus 20. The plating controller 17 is configured to send a signal indicating a replenishment demand value to the operation controller 105 of the plating-solution supply apparatus 20 when the copper ion concentration in the plating solution has become lower than a lower limit of the predetermined management range. Upon receipt of the signal, the plating-solution supply apparatus 20 adds the copper oxide solid CS to the plating solution until the amount of the added copper oxide solid CS reaches the replenishment demand value. More specifically, the motion controller 105 instructs the actuator 112 to drive the actuator 112. The copper oxide solid CS in the storage case 111 is sent to the dissolution tank 100 by the actuator 112. The plating solution in the dissolution tank 100 is sent to the plating-solution tank 150 through the plating-solution supply line 155.

Although in this embodiment the plating controller 17 and the operation controller 105 are constructed as separate devices, in one embodiment the plating controller 17 and the operation controller 105 may be constructed as one controller. In that case, the controller may be a computer that operates in accordance with a program. The program may be stored in a non-transitory storage medium.

The plating apparatus 1 may include concentration measuring devices 18*a* each for measuring the copper ion concentration in the plating solution. The concentration measuring devices 18*a* are attached to the four discharge pipes 37*a* of the plating-solution return pipe 37, respectively. A measured value of the copper ion concentration obtained by each concentration measuring device 18*a* is sent to the plating controller 17. The plating controller 17 may compare the lower limit of the above-described management range with a copper ion concentration in the plating solution calculated from the cumulative value of electric current as discussed previously, or may compare the lower limit of the above-described management range with a copper ion concentration measured by the concentration measuring device (s) 18*a*.

The plating controller 17 may correct the calculated value of the copper ion concentration based on a comparison of a copper ion concentration in the plating solution, calculated from the cumulative value of electric current (i.e., calculated value of the copper ion concentration), with a copper ion concentration measured by the concentration measuring device(s) 18*a* (i.e. measured value of the copper ion concentration). For example, the plating controller 17 may determine a correction factor by dividing a measured value of the copper ion concentration by a calculated value of the copper ion concentration, and correct a calculated value of the copper ion concentration by multiplying the calculated value by the correction factor. The correction factor may preferably be updated periodically.

The plating-solution supply pipe 36 may have a branch pipe 36*b*, which is provided with a concentration measuring device 18*b* to monitor the copper ion concentration in the plating solution. The branch pipe 36*b* may be further provided with an analyzer(s) (e.g. a CVS device or a colorimeter) to perform quantitative analysis and monitoring of the concentration of a dissolved chemical component(s) in addition to the copper ion. Such a construction makes it possible to analyze the concentration of the chemical component, e.g. an impurity, in the plating solution existing in the plating-solution supply pipe 36 before the plating solution is supplied to the plating tanks 2. This can prevent the dissolved impurity from affecting the plating performance and can more ensure highly-precise plating. Only one of the concentration measuring devices 18*a*, 18*b* may be provided.

With the above-described construction, the plating system according to the embodiment can replenish the plating solution with copper while keeping the copper ion concentration in the plating solution substantially equal among the plating tanks 2. The plating tanks 2 may be in fluid communication with each other through liquid circulation passages (not shown) so that concentrations of components in the plating solution are substantially equal among the plating tanks 2.

As a plurality of substrates W are plated in the plating apparatus 1 using the insoluble anode 8, the copper ion concentration in the plating solution is gradually lowered. Thus, the copper oxide solid CS is regularly supplied into the plating solution, so that the copper ion concentration in the plating solution held in the plating tanks 2 is maintained within the predetermined management range. The copper oxide solid CS is dissolved in the dissolution tank 100. The copper oxide solid CS serves as a source of copper ions for the plating solution.

In one embodiment, the feeding mechanism 110 may include a plurality of storage cases 111 for storing each of a plurality of copper oxide solids CS having different sizes (more specifically, a specified amount) and a corresponding number of actuators 112 for the number of storage cases 111. The number of storage cases 111 corresponds to the number of sizes of copper oxide solid CS, and one storage case 111 stores one size of copper oxide solid CS.

These actuators 112 are connected to the operation controller 105. The operation controller 105 can operate the plurality of actuators 112 independently. The operation controller 105 operates the actuator 112 to feed at least one of a plurality of copper oxide solids CS having different sizes so that the copper ion concentration in the plating solution is maintained within a predetermined control range. With such a configuration, the plating-solution supply apparatus 20 can easily control the copper ion concentration in the plating solution.

In one embodiment, the copper oxide solid CS may be continuously added until the copper ion concentration in the plating solution reaches a saturated concentration. The plating solution in the dissolution tank 100 is supplied to the plating-solution tank 150 in a state in which the saturated state of copper oxide with respect to the plating solution (i.e., the state in which copper oxide is dissolved in the plating solution to the solubility) is always maintained.

Figure 12:
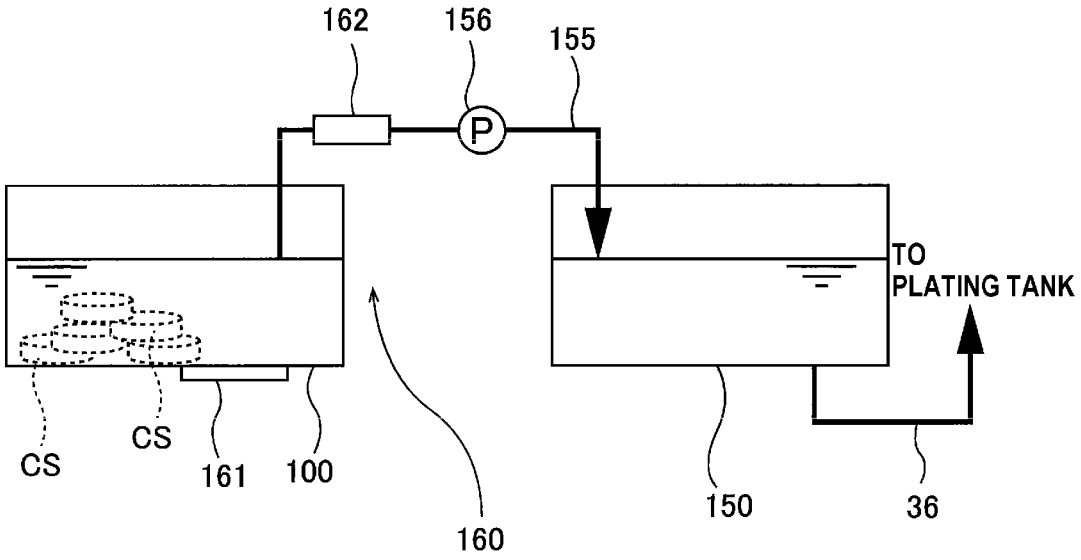
FIG. 12 is a view showing an embodiment of a deposition prevention apparatus provided in a plating-solution supply apparatus.

FIG. 12 is a view showing an embodiment of a deposition prevention apparatus 160 provided in the plating-solution supply apparatus 20. In FIG. 12, the agitator 120 is not shown. If the solubility of the copper oxide in the plating solution is exceeded, the copper oxide may crystallize and deposit in the plating solution. Therefore, the plating-solution supply apparatus 20 includes the deposition prevention apparatus 160 for preventing the deposition of copper oxide.

It is generally known that the solubility of a substance depends on a temperature. Therefore, as the temperature of the plating solution increases, more copper oxide dissolves in the plating solution. As shown in FIG. 12, the deposition prevention apparatus 160 includes a cooler 161 for cooling the plating solution in the dissolution tank 100 and a heater 162 for heating the plating solution flowing through the plating-solution supply line 155. The cooler 161 is attached to the dissolution tank 100, and the heater 162 is attached to the plating-solution supply line 155. In this embodiment, the heater 162 is arranged on an upstream side of the pump 156 in a transfer direction of the plating solution, but may be arranged on a downstream side of the pump 156.

As described above, since the solubility of the copper oxide depends on the temperature of the plating solution, the solubility of the copper oxide can be determined based on the temperature of the plating solution. In this embodiment, the cooler 161 cools the plating solution in the dissolution tank 100 to a predetermined cooling temperature. The actuator 112 feeds an amount of the copper oxide solid CS corresponding to the solubility determined based on the temperature of the cooled plating solution into the dissolution tank 100 to maintain the saturated state of copper oxide with respect to the plating solution.

The heater 162 heats the plating solution flowing through the plating-solution supply line 155 to a predetermined heating temperature. This heating temperature is a temperature that does not adversely affect the properties of the plating solution. As the plating solution is heated, the solubility of the copper oxide in the plating solution increases, so the heater 162 heats the plating solution to prevent the deposition of the copper oxide in an inside of the plating-solution supply line 155.

Figure 13:
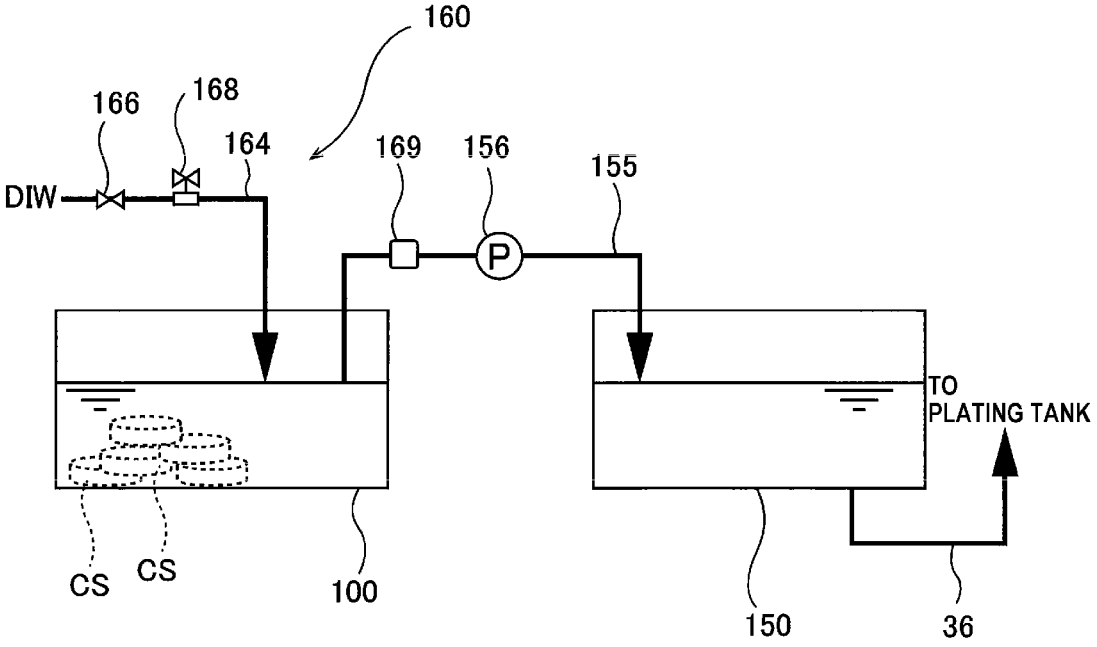
FIG. 13 is a view showing another embodiment of the deposition prevention apparatus.

In another embodiment, the deposition prevention apparatus 160 may be configured to reduce a concentration of sulfuric acid ($H_2SO_4$) contained in the plating solution in the dissolution tank 100. FIG. 13 is a view showing another embodiment of the deposition prevention apparatus 160. In FIG. 13, the agitator 120 is not shown.

It is generally known that the solubility of the copper oxide increases as the sulfuric acid concentration decreases. Therefore, the deposition prevention apparatus 160 is configured to prevent the deposition of the copper oxide by decreasing the sulfuric acid concentration in the plating solution.

As shown in FIG. 13, the deposition prevention apparatus 160 includes a pure-water supply line 164 for supplying pure water into the dissolution tank 100. The pure-water supply line 164 is provided with an on-off valve 166 for stopping the supply of pure water and a flow control valve 168 for controlling a flow rate of pure water. Although not shown, a flow meter for measuring the flow rate of pure water may be arranged in the pure-water supply line 164.

The deposition prevention apparatus 160 further includes a sulfuric-acid concentration meter 169 for measuring the sulfuric acid concentration in the dissolution tank 100. In this embodiment, the sulfuric-acid concentration meter 169 is arranged on the plating-solution supply line 155. The operation controller 105 is configured to control a degree of opening of the flow control valve 168 so that the sulfuric acid concentration in the plating solution becomes a predetermined concentration based on the sulfuric acid concentration of the plating solution measured by the sulfuric-acid concentration meter 169.

In this manner, the deposition prevention apparatus 160 can reduce the sulfuric acid concentration by supplying pure water into the dissolution tank 100. The actuator 112 feeds an amount of copper oxide solid CS corresponding to the solubility determined based on the sulfuric acid concentration of the diluted plating solution into the dissolution tank 100 to maintain the saturated state of the copper oxide with respect to the plating solution. In one embodiment, the embodiment shown in FIG. 12 and the embodiment shown in FIG. 13 may be combined. In one embodiment, the pure-water supply line 164 may be a branch line branched from the pure-water supply line 42 shown in FIG. 1.

In the embodiment described with reference to FIGS. 12 and 13, the copper oxide solid CS is fed into the dissolution tank 100 until the copper ion concentration in the plating solution reaches a saturated concentration. In another embodiment, the copper oxide solid CS may be fed so that the copper ion concentration in the plating solution is maintained at a predetermined target concentration of less than the saturated concentration.

Figure 14:
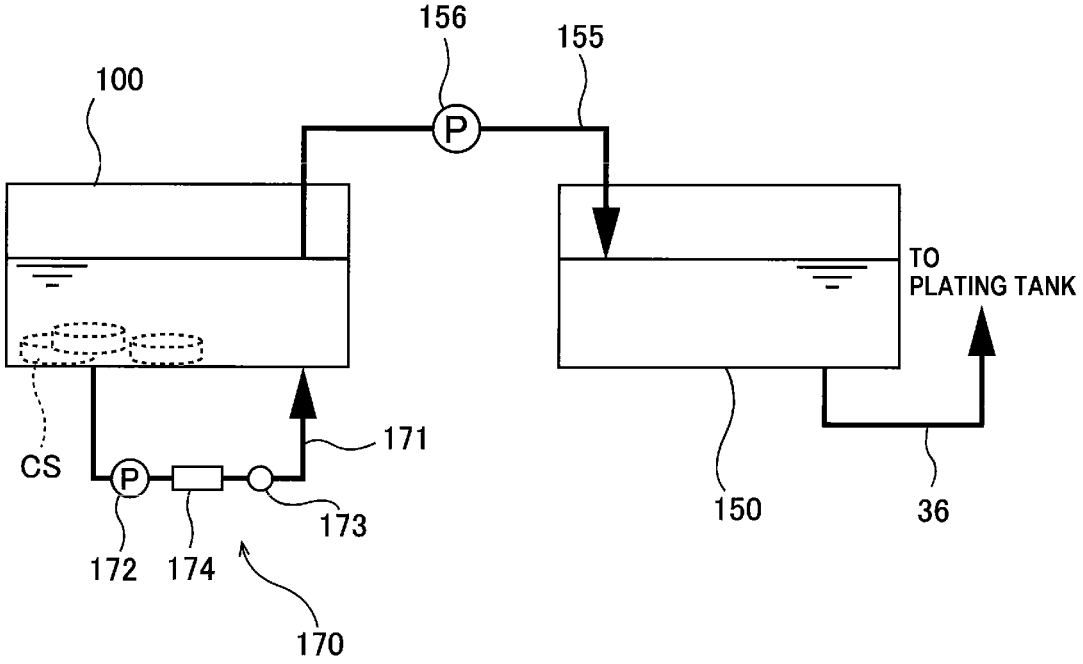
FIG. 14 is a view showing a concentration control mechanism that maintains a copper ion concentration in the plating solution at a predetermined target concentration.

FIG. 14 is a view showing a concentration control mechanism 170 that maintains the copper ion concentration in the plating solution at a predetermined target concentration. As shown in FIG. 14, the plating-solution supply apparatus 20 includes a concentration control mechanism 170. The concentration control mechanism 170 includes a circulation line 171 connected to the bottom of the dissolution tank 100, a circulation pump 172 for circulating the plating solution between the dissolution tank 100 and the circulation line 171, a concentration measuring device 173 for measuring the copper ion concentration in the plating solution flowing through the circulation line 171, and a temperature regulator 174 for regulating the temperature of the plating solution flowing through the circulation line 171.

The circulation pump 172, the concentration measuring device 173, and the temperature regulator 174 are arranged on the circulation line 171. Arrangements of the circulation pump 172, the concentration measuring device 173, and the temperature regulator 174 are not limited to the embodiment shown in FIG. 14.

When the circulation pump 172 is driven, the plating solution circulates and is agitated between the dissolution tank 100 and the circulation line 171. Since the combination of the circulation line 171 and the circulation pump 172 can dissolve the copper oxide solid CS in the dissolution tank 100, the combination of these serves the same role as the above-described agitator 120. The agitator by the combination of the circulation line 171 and the circulation pump 172 and the agitator 120 described above may be combined. With such a combination, the copper oxide solid CS is dissolved more reliably and more quickly.

The concentration measuring device 173 may have the same configuration as the above-described concentration measuring devices 18*a* and 18*b*. In one embodiment, the concentration measuring device 173 is an in-line Cu concentration measuring device. An example of the concentration measuring device 173 includes an InVue (registered trademark) CR288 concentration monitor manufactured by Entegris (registered trademark). The concentration measuring device 173 is connected to the operation controller 105, and measured values of the copper ion concentration obtained by the concentration measuring device 173 is sent to the operation controller 105.

The temperature regulator 174 includes a temperature sensor (not shown) for detecting the temperature of the plating solution. The temperature regulator 174 regulates the temperature of the plating solution flowing through the circulation line 171 so that the temperature of the plating solution is maintained at a predetermined temperature lower than the saturated temperature based on the temperature of the plating solution detected by the temperature sensor. The temperature regulator 174 is connected to the operation controller 105. As described above, since the solubility of the copper oxide changes depending on the temperature of the plating solution, the operation controller 105 can control the solubility of the copper oxide by the temperature regulator 174.

The operation controller 105 operates the actuator 112 so that the copper ion concentration of the plating solution in the dissolution tank 100 becomes a predetermined target concentration (concentration less than the saturated concentration) based on the measured value sent from the concentration measuring device 173. The actuator 112 feeds the copper oxide solid CS into the dissolution tank 100 based on a command from the operation controller 105. The operation controller 105 supplies the plating solution maintained at a predetermined target concentration into the plating-solution tank 150 by driving the pump 156.

In the embodiment shown in FIG. 14, since the copper ion concentration of the plating solution in the dissolution tank 100 is maintained at a concentration less than the saturated concentration, the copper oxide does not deposit in the plating solution. Therefore, in this embodiment, the above-described deposition prevention apparatus 160 can be eliminated.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a copper oxide solid for use in plating of a substrate using an insoluble anode. The present invention is applicable to a method of producing the copper oxide solid. The present invention is applicable to an apparatus for supplying a plating solution in which the copper oxide solid is dissolved into a plating tank.

REFERENCE SIGNS LIST

1 plating apparatus
2 plating tank
5 inner tank
6 outer tank
8 insoluble anode
9 anode holder
11 substrate holder

15 plating power source
17 plating controller
18*a* concentration measuring device
18*b* concentration measuring device
20 plating-solution supply apparatus
36 plating-solution supply pipe
36*a* branch pipe
36*b* branch pipe
37 plating-solution return pipe
37*a* discharge pipe
38 flow meter
39 flow control valve
40 pump
41 filter
42 pure-water supply line
43 on-off valve
44 flow meter
47 flow control valve
100 dissolution tank
105 operation controller
110 feeding mechanism
111 storage case
111*a* body portion
111*b* lid portion
112 actuator
112*a* piston rod
112*b* cylinder body
113 supporter
114 push-up device
115 push-out device
116 upper-side disk member
116*a* upper-side coupling hole
117 lower-side disk member
117*a* lower-side coupling hole
118 motor
120 agitator
121 agitator
122 motor
130 supply port
131 communication hole
132 communication hole
140 inert-gas supply mechanism
141 gas supply source
142 gas nozzle
143 coupling line
144 on-off valve
150 plating-solution tank
155 plating-solution supply line
156 pump
160 deposition prevention apparatus
161 cooler
162 heater
164 pure-water supply line
166 on-off valve
168 flow control valve
169 sulfuric-acid concentration meter
170 concentration control mechanism
171 circulation line
172 circulation pump
173 concentration measuring device
174 temperature regulator

The invention claimed is:

1. A copper oxide solid to be supplied into a plating solution for plating a substrate, comprising:

a copper oxide powder; and a liquid as a binder to bind the copper oxide powder, the liquid comprising the plating solution to which no additives have been added.

2. The copper oxide solid according to claim 1, wherein the copper oxide solid comprises:

an outer portion comprising a surface of the copper oxide solid; and an inner portion located inside the outer portion, and a water content of the outer portion is larger than a water content of the inner portion.

3. The copper oxide solid according to claim 1, wherein a surface of the copper oxide solid has a concavo-convex shape.

* * * * *